US005589914A

United States Patent [19]

Katsuhara

[11] Patent Number: 5,589,914

[45] Date of Patent: Dec. 31, 1996

[54] DENSITY DETECTING DEVICE USED FOR IMAGE FORMING APPARATUS

[75] Inventor: Kenji Katsuhara, Osaka, Japan

[73] Assignee: Mita Industrial Co., Ltd., Osaka, Japan

[21] Appl. No.: 517,232

[22] Filed: Aug. 21, 1995

[30] Foreign Application Priority Data

Sep. 20, 1994 [JP] Japan ..... 6-225177

[51] Int. Cl.[6] ..... G03G 15/00

[52] U.S. Cl. ..... 399/60

[58] Field of Search ..... 355/203, 208, 355/214, 246

[56] References Cited

U.S. PATENT DOCUMENTS 5,497,221 3/1996 Takemoto ..... 355/208

*Primary Examiner*—Joan H. Pendegrass
*Attorney, Agent, or Firm*—Beveridge, DeGrandi, Weilacher & Young LLP

[57] ABSTRACT

A device and method for detecting a toner image density accurately while using a characteristic curve found at the time of initialization. In the initialization, light of a first amount for low density is irradiated onto a photoreceptor from a density sensor, to acquire a first low-density light amount characteristic curve. In the characteristic curve, a toner image density corresponding to first density data is taken as a first reference density. A first amount of light for high density is then set to acquire a high-density light amount characteristic curve. In the characteristic curve, density data corresponding to the first reference density is taken as first correcting reference data. In density detection, a second amount of light for low density and a second amount of light for high density are found. A second low-density light amount characteristic curve corresponding to the second amount for low density is acquired. The density of a toner image having the second reference density approximately equal to the first reference density is detected by the density sensor irradiating light of the second amount for high density. The density data outputted by the density sensor is taken as second correcting reference data. If the second amount for high density is set, the density data outputted by the density sensor is corrected on the basis of the first and second correcting reference density data.

16 Claims, 7 Drawing Sheets

DENSITY DETECTING DEVICE USED FOR IMAGE FORMING APPARATUS

BACKGROUND OF THE INVENTION

1. Field of the Invention

The present invention relates to a density detecting device and method, used for an image forming apparatus for forming an image by an electrophotographic process, for example, an electrostatic copying machine, for outputting density data utilized in adjusting the image forming conditions such as the amount of charge, the amount of exposure and the developing bias so as to keep the formed image high in quality.

2. Description of the Related Art

In the electrostatic copying machine, a copy image is formed in the following manner. Specifically, a real original which is put on a transparent platen is illuminated and scanned. Reflected light from the real original is introduced into a photosensitive drum which is rotated in synchronization with the illumination and scanning. As a result, the photosensitive drum is exposed. The surface of the photosensitive drum before the exposure is uniformly charged by a charger. An electrostatic latent image corresponding to the real original is formed on the surface of the photosensitive drum by selective charge elimination by the exposure.

The formed electrostatic latent image is developed into a toner image by a developing device to which toner is supplied from a toner hopper. The toner image is transferred onto copy paper by corona discharges in a transferring corona discharger. The copy paper on which the toner image has been transferred is introduced into a fixing device, where the toner is fixed to the copy paper, thereby completing copying.

An attempt to stably obtain an image high in quality in the above described electrostatic copying machine brings about the necessity of suitably adjusting the image forming conditions such as the amount of exposure and the amount of charge of the photosensitive drum, the developing bias and the amount of toner to be supplied to the developing device.

The image forming conditions are adjusted for each predetermined period, for example, at the time of maintenance. In adjusting the image forming conditions, a pure white or solid black pseudo original (a reference density original) arranged in a region other than a region where the real original is illuminated and scanned is experimentally illuminated, and a toner image corresponding to the pseudo original is formed. At this time, the amount of exposure, the surface potential, the density of the toner image on the surface of the photosensitive drum, and the like are detected, and the image forming conditions are automatically adjusted on the basis of the results of the detection. Specifically, in a case where the pure white pseudo original is illuminated to form a toner image, if so-called fog is detected on the basis of the detected toner image density, the amount of exposure is increased. On the other hand, in a case where the solid black pseudo original is illuminated to form a toner image, if it is judged that the density is insufficient on the basis of the results of the detection of the toner image density, toner is automatically supplied to the developing device from the toner hopper.

A reflection type photosensor which is constituted by a light emitting element and a light receiving element arranged opposed to the photosensitive drum is generally applied to the detection of the density of the toner image on the surface of the photosensitive drum. Specifically, light of a previously set amount is irradiated onto the photosensitive drum from the light emitting element, and density data corresponding to the amount of light reflected from the photosensitive drum is outputted from the light receiving element. Since the amount of the reflected light corresponds to the density of the toner image on the surface of the photosensitive drum, it is possible to detect the density of the toner image on the surface of the photosensitive drum on the basis of the above described density data.

At the time of initialization immediately after manufacturing the copying machine, two types of amounts of light to be irradiated, for example, an amount of light for low density and an amount of light for high density are set as an amount of light to be irradiated onto the photosensitive drum from the light emitting element in the reflection type photosensor. The amount of light for low density is an amount of light to be irradiated onto the photosensitive drum from the light emitting element when fog is detected. On the other hand, the amount of light to be irradiated for high density is an amount of light to be irradiated when a solid black is detected.

The reason why the amount of light to be irradiated is varied depending on a case where fog is detected and a case where a solid black is detected is as follows.

Specifically, when the fog is detected, the pseudo original on which a pure white image is formed is illuminated, whereby toner hardly adherers to the photosensitive drum. Consequently, the amount of light received by the light receiving element is relatively high. On the other hand, an output of the light receiving element is saturated if the amount of received light is increased. Therefore, the amount of light to be irradiated in the fog detection must be made relatively small so as to restrain the amount of light reflected from the photosensitive drum.

On the other hand, when a solid black is detected, the pseudo original on which a solid black image is formed is illuminated, whereby a large amount of toner adheres to the photosensitive drum. Consequently, most of light irradiated from the light emitting element is absorbed by the toner on the surface of the photosensitive drum, whereby the amount of light received by the light receiving element is relatively small. On the other hand, the light receiving element cannot detect a subtle change in the amount of received light if the amount of received light is small. Therefore, the amount of light to be irradiated when a solid black is detected must be made relatively large so as to increase the amount of reflected light.

FIG. 7 is a diagram showing the relationship between the density of a toner image on the surface of the photosensitive drum and density data outputted from the reflection type photosensor in a case where the amount of light for low density is set. Referring to FIG. 7, the density data outputted from the reflection type photosensor relatively linearly changes in a low-density region El, while hardly changing in a high-density region E2. That is, the reflection type photosensor can detect the change in density in the low-density region E1 with high precision in a case where the amount of light for low density is set. Therefore, it is possible to detect fog with high precision.

FIG. 8 is a diagram showing the relationship between the density of a toner image on the surface of the photosensitive drum and density data outputted from the reflection type photosensor in a case where the amount of light for high density is set. Referring to FIG. 8, the density data outputted from the reflection type photosensor hardly changes in a low-density region E1, while relatively linearly changing in a high-density region E2. That is, the reflection type photosensor can detect the change in density in the high-density region E2 with high precision in a case where the amount of light for high density is set. Therefore, it is possible to detect a solid black with high precision.

The predetermined amount of light for low density and the predetermined amount of light for high density, which are set at the time of the initialization, are also utilized for image forming condition adjusting processing performed for each predetermined time period. However, circumstances around the photosensor or status of the copying machine at the time of the image forming condition adjusting processing is different from that at the time of the initialization. Hence, toner image density is not always detected correctly, if the fixed amounts of light obtained at the time of the initialization are used at the time of the image forming condition adjusting processing. Consequently, the image forming conditions cannot be accurately adjusted, thereby making impossible to obtain an image high in quality.

SUMMARY OF THE INVENTION

An object of the present invention is to provide a density detecting device used for an image forming apparatus capable of accurately detecting the density of a toner image at the time of density detection while using a high-density light amount characteristic curve found at the time of initialization.

Another object of the present invention is to provide a density detecting method in which the density of a toner image can be accurately detected at the time of density detection while using a high-density light amount characteristic curve found at the time of initialization.

Still another object of the present invention is to provide a density detecting device for setting an amount of light to be irradiated onto a photoreceptor from a density sensor at the time of density detection again, thereby to improve density detecting precision.

A further object of the present invention is to provide a density detecting method in which an amount of light to be irradiated onto a photoreceptor from a density sensor at the time of density detection is set again, thereby to improve density detecting precision.

According to the present invention, at the time of initialization, a first amount of light for low density for detecting a toner image density in a low-density region is first set as an amount of light to be irradiated onto a photoreceptor from a density sensor. The density of a toner image having a known density is detected by a density sensor. Consequently, a first low-density light amount characteristic curve which shows input-output characteristics corresponding to the first amount of light for low density of the density sensor is acquired. A first amount of light for high density for detecting a toner image density in a high-density region is then set as the amount of light to be irradiated onto the photoreceptor. The density of a toner image having a known density is detected by the density sensor. Consequently, a high-density light amount characteristic curve which is input-output characteristics corresponding to the first amount of light for high density of the density sensor is acquired. A toner image density corresponding to first density data in the first low-density light amount characteristic curve is taken as a first reference density. In the high-density light amount characteristic curve, density data corresponding to the first reference density is acquired as first correcting reference data.

On the other hand, at the time of density detection, a second amount of light for low density for detecting a toner image density in the low-density region is found again. In addition, a second amount of light for high density for detecting a toner image density in the high-density region is found. The second amount of light for low density is set as the amount of light to be irradiated onto the photoreceptor. In this state, the density of the toner image having a known density is detected by the density sensor. Consequently, a second low-density light amount characteristic curve of the density sensor is acquired. In the second low-density light amount characteristic curve, a toner image density corresponding to second density data approximately equal to the first density data is taken as a second reference density. As the amount of light to be irradiated onto the photoreceptor, the second amount of light for high density is then set. In this state, the density of a toner image having the second reference density is detected by the density sensor. At this time, density data outputted by the density sensor is taken as second correcting reference data.

In setting the second amount of light for high density to detect a toner image density by the density sensor, the density data outputted by the density sensor is corrected on the basis of the first correcting reference data and the second correcting reference data. The corrected density data is applied to the high-density light amount characteristic curve, thereby acquiring the toner image density.

According to the present invention, therefore, the first and second correcting reference data are respectively found at the time of initialization and the time of density detection. Both the first and second correcting reference data correspond to the amount of light for high density. Since the first density data and the second density data are approximately equal, the first and second correcting reference data are density data outputted by the density sensor which correspond to toner image densities which are approximately equal. Specifically, if the first correcting reference data and the second correcting reference data differ from each other, this means that the input-output characteristics of the density sensor which correspond to the amount of light for high density differ between at the time of the initialization and at the time of the density detection is performed. In the present invention, therefore, the density data outputted by the density sensor is corrected on the basis of the first and second correcting reference data, thereby making it possible to accurately detect the density by the density sensor while using the high-density light amount characteristic curve found at the time of the initialization.

Furthermore, according to the present invention, the second amount of light for low density and the second amount of light for high density are found again at the time of the density detection. Consequently, it is also possible to measure the density with high precision by excluding the effect such as the difference in mechanical conditions between the time of the initialization and at the time of the density detection.

It is preferable that the density data outputted by the density sensor is corrected through the correction of the high-density light amount characteristic curve on the basis of the first and second correcting reference data. In this case, the density can be acquired by applying the density data outputted by the density sensor to the high-density light amount characteristic curve after the correction. Specifically, a high-density light amount characteristics curve represented by a plurality of density data $D_S$DAT and a plurality of density values corresponding to the plurality of density data $D_S$DAT is stored in first storing means. In correcting the density data, the plurality of density data $D_S$DAT are respectively corrected in accordance with the following equation on the basis of the first and second correcting reference data $D_{ST}$ and $D_{SF}$, to acquire density data $D_S$DAT' after the correction:

$$D_S DAT' = K \times D_S DAT \text{ where } K = D_{ST}/D_{SF}.$$

The density data $D_S$DAT' after the correction and the density data $D_S$DAT before the correction are stored in second storing means with a correspondence established therebetween. When the density is to be acquired, the density data which is closest to the density data outputted by the density sensor is obtained from of the density data $D_S$DAT before the correction in the second storing means. The density data $D_S$DAT' after the correction which corresponds to the found density data $D_S$DAT before the correction is read out from the second storing means. In addition, the density value corresponding to the read density data $D_S$DAT' after the correction is read out from the first storing means.

Alternatively, the density data outputted by the density sensor may be corrected through the correction of the density data outputted by the density sensor may be corrected on the basis of the ratio of the first correcting reference data to the second correcting reference data. Specifically, density data $D_S$ outputted by the density sensor may be corrected in accordance with the following equation on the basis of first correcting reference data $D_{ST}$ and second correcting reference data $D_{SF}$, to obtain density data $D_S$" after the correction:

$$D_S = K \times D_S \text{ where } K = D_{ST}/D_{SF}.$$

The first amount of light for low density may be determined by performing the steps of: irradiating light of amounts in a plurality of steps by the density sensor onto the photoreceptor on which no toner adheres, finding out a maximum step of steps in which data outputted by the density sensor takes a value of not less than a predetermined value, and determining the amount of light in the maximum step as the first amount of light for low density. In this case, the first amount of light for high density may be an amount of light found by substituting the first amount of light for low density into a predetermined conversion equation.

Furthermore, the second amount of light for low density may be determined by performing the steps of: irradiating light of amounts in a plurality of steps by the density sensor onto the photoreceptor on which no toner adheres, finding out a maximum step then the predetermined value, and determining the amount of light in the maximum step of steps in which data outputted by the density sensor takes a value of not less than the predetermined value, and determining the amount of light in the maximum step as the second amount of light for low density. In this case, the second amount of light for high density may be found by substituting the second amount of light for low density in the predetermined conversion equation.

The relationship between the amount of light for low density and the amount of light for high density at the time of the density detection differs from that at the time of the initialization. This is mainly attributable to toner and paper particles adhered on the light receiving surface of the density sensor, for example. Hence, since the second amount of light for high density is obtained by substituting the second amount of light for low density into the fixed conversion equation, the second amount of light for high density may have an improper value. For this reason, the input-output characteristics of the density sensor in which the second amount of light for high density is set (see dashed line in FIG. 8) may differ from the input-output characteristics of the density sensor in which the first amount of light for high density is set at the time of the initialization (see solid line in FIG. 8). An error of density detection may therefore occur if the high density light amount characteristic curve acquired at the time of the initialization is used as it is. The correction of the density data outputted by the density sensor, according to the invention, ensures the density detection in high precision while using the high density light amount characteristic curve.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
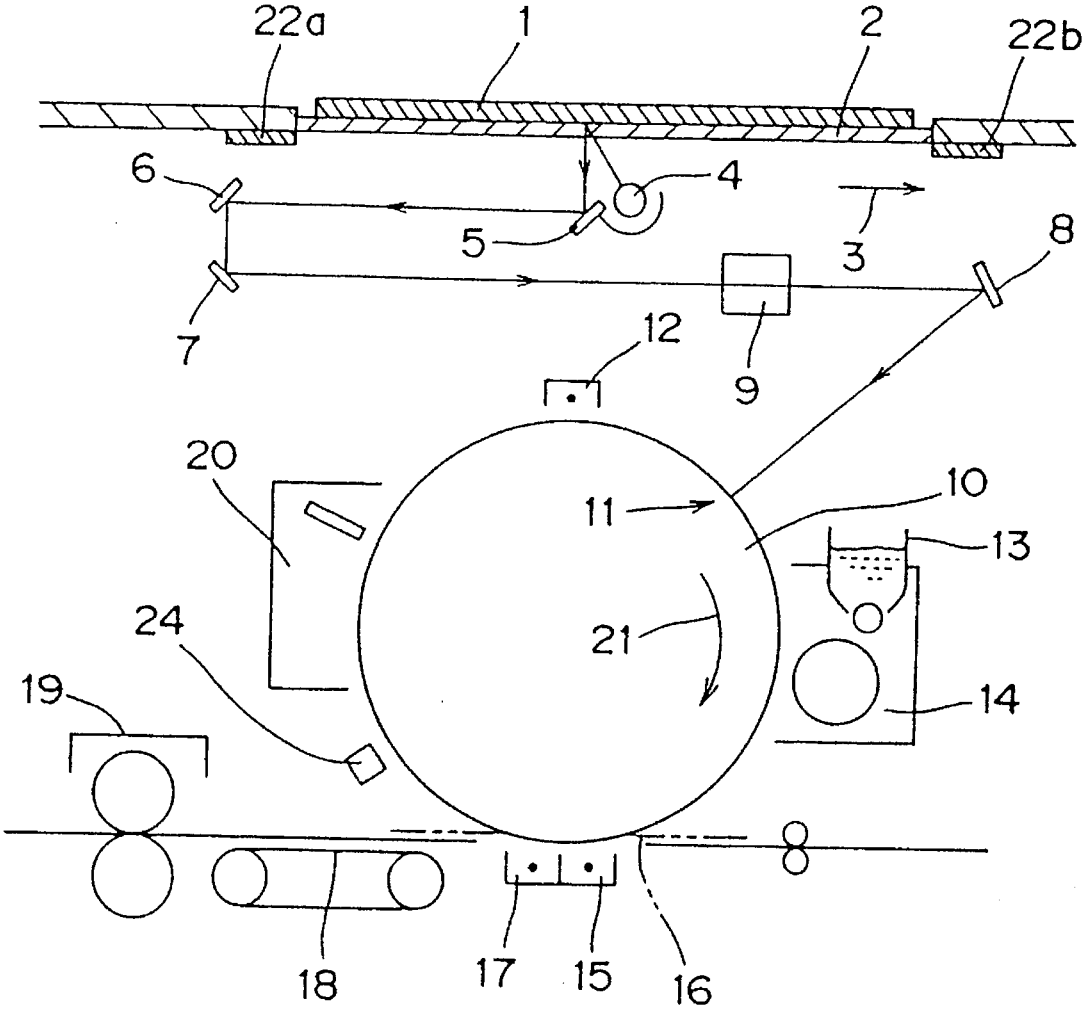
FIG. 1 is a conceptual diagram showing the schematic construction of an electrostatic copying machine to which a density detecting device according to one embodiment of the present invention is applied.

FIG. 1 is a conceptual diagram showing the schematic construction of an electrostatic copying machine including a density detecting device according to one embodiment of the present invention. There is provided, below a transparent platen 2 composed of transparent glass on which a real original 1 is to be put, a light source 4 for illuminating and scanning the surface of the real original 1 put on the transparent platen 2. The light source 4 is composed of a halogen lamp or the like, which is conveyed at a predetermined speed in a direction indicated by an arrow 3 at the time of an image forming operation.

Reflected light from the original is introduced into an exposure region 11 on the surface of a photosensitive drum 10, guided by reflecting mirrors 5, 6, 7 and 8 and going through a zoom lens 9. On the other hand, the surface of the photosensitive drum 10 immediately before the exposure by the reflected light is uniformly charged by a charging corona discharger 12. As a result, an electrostatic latent image corresponding to the real original 1 is formed on the surface of the photosensitive drum 10.

At the time of the image forming operation, the reflecting mirror 5, along with the light source 4, is conveyed, and the reflecting mirrors 6 and 7 are conveyed in the direction indicated by the arrow 3 at a speed which is one-half the speed of conveyance of the light source 4. The photosensitive drum 10 is rotated and driven in a direction indicated by an arrow 21 in synchronization with the movement of the light source 4.

The electrostatic latent image formed on the surface of the photosensitive drum 10 is developed into a toner image by a developing device 14 to which toner is supplied from a toner hopper 13. The developed toner image is transferred onto the surface of copy paper 16 at a transferring corona discharger 15. The copy paper 16 on which the toner image has been transferred is separated from the photosensitive drum 10 by a separating corona discharger 17, and then is introduced into a fixing device 19 by a conveying belt 18. In the fixing device 19, the toner is fixed by heating on the surface of the copy paper 16, thereby completing copying.

The toner remaining on the surface of the photosensitive drum 10 after the transfer of the toner image is removed by a cleaning device 20, to prepare for the subsequent copying.

Pseudo originals 22*a* and 22*b* which are density reference originals respectively carrying a pure white image and a solid black image are respectively provided on both sides of the transparent platen 2 and inside the main body of the copying machine. The pseudo originals 22*a* and 22*b* are used in adjusting the density of an image to be formed on the copy paper 16, as described later.

Furthermore, a reflection type photosensor 24 constituting a part of a density detecting device 23 as described below is provided so as to be opposed to the photosensitive drum 10 in a position in the vicinity of the photosensitive drum 10 between the separating corona discharger 17 and the cleaning device 20.

Figure 2:
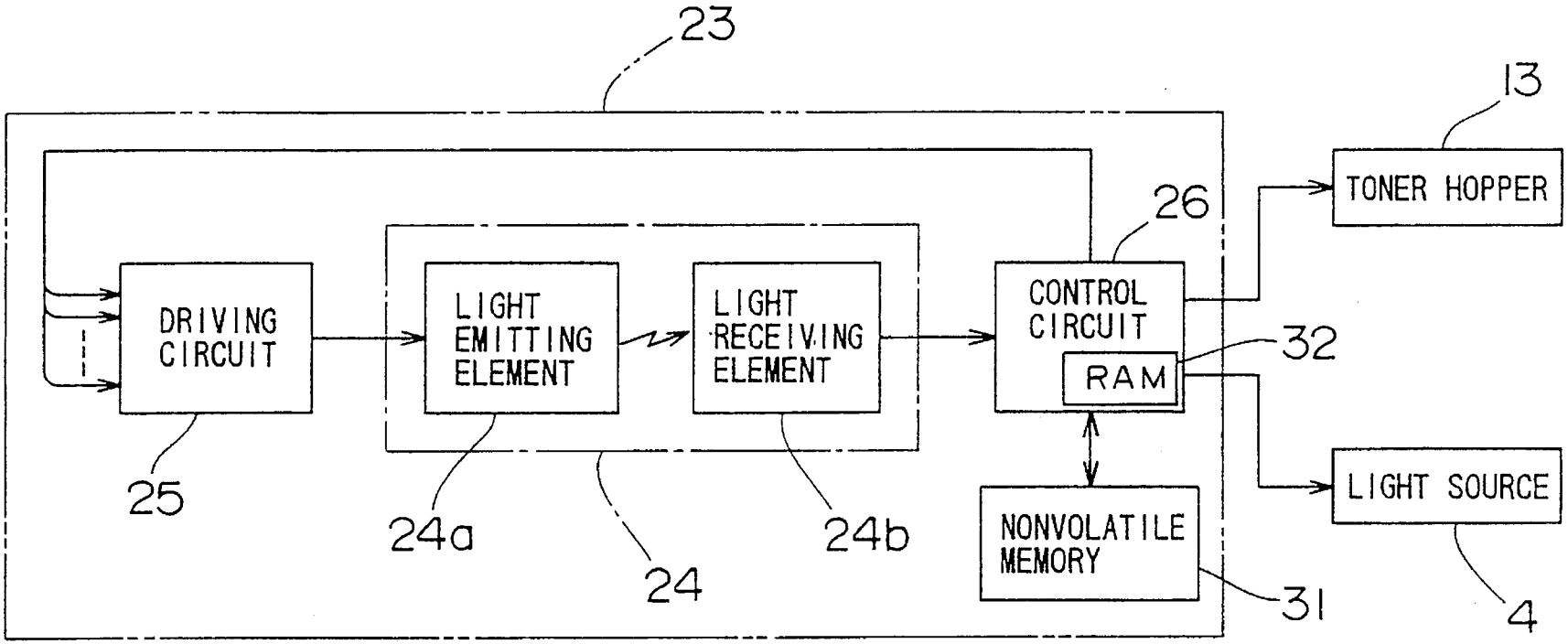
FIG. 2 is a block diagram showing the electrical construction of the density detecting device constituting a part of the electrostatic copying machine.

FIG. 2 is a block diagram showing the electrical construction of the density detecting device 23. The density detecting device 23 is made use of at the time of image forming condition adjusting processing as described later in order to adjust the density of an image to be formed on the copy paper 16. At the time of the image forming condition adjusting processing, either the pseudo original 22*a* or 22*b* is experimentally illuminated, thereby forming a toner image having a density corresponding to the pseudo original on the photosensitive drum 10. The density of the formed toner image is detected by the density detecting device 23, and the image forming conditions such as the amount of exposure and the amount of toner to be supplied to the developing device 14 are adjusted on the basis of the results of the detection.

As described above, the density detecting device 23 includes the reflection type photosensor 24. The reflection type photosensor 24 includes a light emitting element 24*a* composed of a light emitting diode (LED) for irradiating light of a predetermined amount onto the photosensitive drum 10, for example, and a light receiving element 24*b* composed of a Darlington type phototransistor for receiving light reflected from the photosensitive drum 10, for example, and is driven by a driving circuit 25.

A code represented by a binary code corresponding to a voltage to be supplied to the light emitting element 24*a* is fed from a control circuit 26 to the driving circuit 25. The control circuit 26 generates the code corresponding to the voltage to be applied to the light emitting element 24*a* in accordance with a predetermined program. The driving circuit 25 applies a voltage corresponding to the fed code to the light emitting element 24*a*. Consequently, light of an amount corresponding to the voltage is irradiated onto the photosensitive drum 10.

A part of the light irradiated onto the photosensitive drum 10 is reflected from the surface of the photosensitive drum 10, and the remaining part is absorbed by toner on the surface of the photosensitive drum 10. Consequently, light of a relatively large amount is reflected if a toner image density is relatively low, while light in a relatively small amount is reflected if the toner image density is relatively high.

The above described reflected light is received by the light receiving element 24*b*. The light receiving element 24*b* generates density data inversely proportional to the amount of the reflected light and feeds the generated density data to the control circuit 26. That is, density data corresponding to the toner image density is fed to the control circuit 26.

The above described control circuit 26 is constituted by a microcomputer including a CPU (Central Processing Unit), a RAM (Random Access Memory) 32 and a ROM (Read-only Memory), for example, and functions as density curve acquiring means, first reference density acquiring means, first correcting reference data acquiring means, light amount acquiring means, second reference density acquiring means, second correcting reference data acquiring means, density data correcting means, density acquiring means, and the like in the present embodiment. The control circuit 26 performs initialization processing and image forming condition adjusting processing as described later on the basis of the density data outputted from the light receiving element 24*b*. A programmable nonvolatile memory 31 for storing data related to the input-output characteristics of the reflection type photosensor 24 is connected to the control circuit 26. The nonvolatile memory 31 may be composed of a RAM with a backup power supply or an EEPROM (Electrically Erasable and Programmable ROM), for example.

Figure 3:
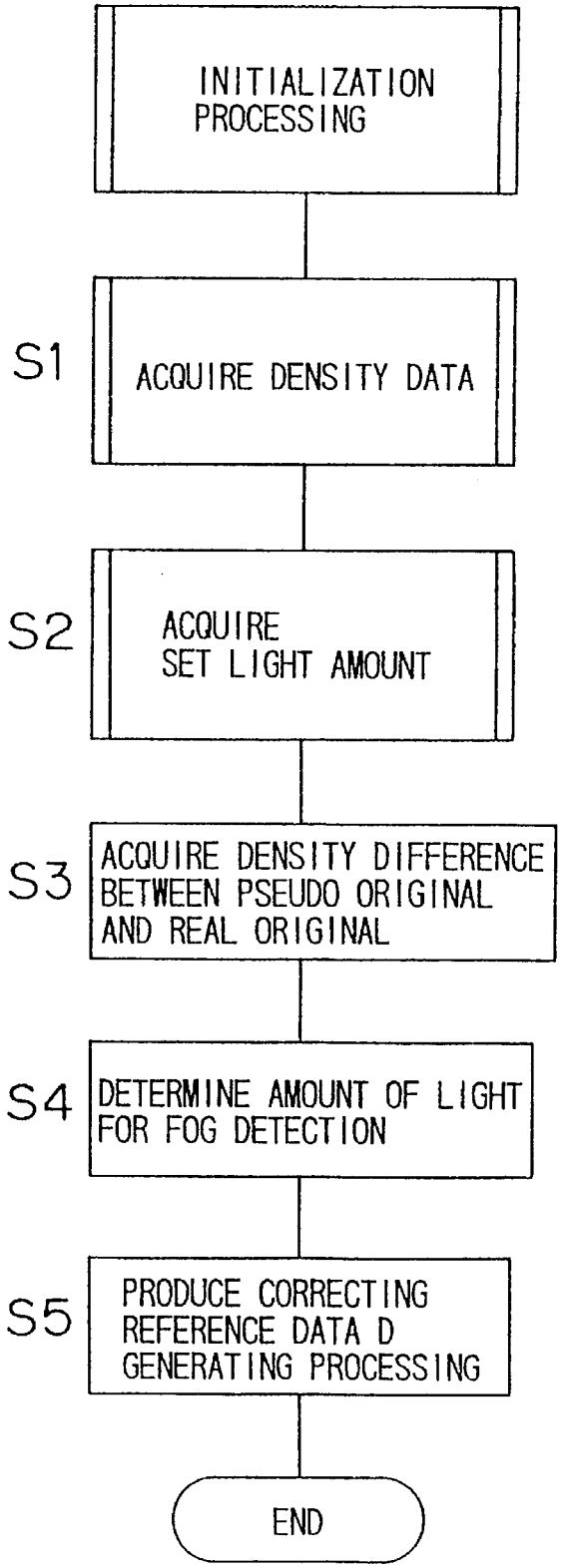
FIG. 3 is a flow chart for explaining initialization processing in the electrostatic copying machine.

FIG. 3 is a flow chart for explaining initialization processing performed before the copying machine is used by a user. In the initialization processing, density data is first acquired (step S1).

More specifically, light of a maximum amount $L_{max}$ and light of a minimum amount $L_{min}$ out of a plurality of amounts of light to be irradiated in predetermined steps are irradiated onto the photosensitive drum 10 from the light emitting element 24*a* in the reflection type photosensor 24 in a state where the photosensitive drum 10 which has not been developed (that is, on which no toner adheres) is kept stationary. Density data $D_{smin}$ and $D_{smax}$ respectively corresponding to light of the maximum amount $L_{max}$ and light of the minimum amount $L_{min}$ are acquired.

Light of the amounts L incremented for each step successively from the minimum amount $L_{min}$ is irradiated onto the photosensitive drum 10 from the light emitting element 24*a*. Consequently, a plurality of density data $D_s$ respectively corresponding to the amounts of light L in the plurality of steps are acquired. In incrementing the amounts of light L for each step to acquire the density data $D_s$ in the step, it is examined whether or not the density data $D_s$ satisfies the following expression (1):

$$D_s<D_{smin}+V_0 \quad (1)$$

where $V_0$=0.2 (V), for example.

If the foregoing expression (1) is satisfied, the amount of light L in a step immediately before the expression is satisfied is taken as a reference amount of light $L_0$, and density data $D_s$ obtained corresponding to reference amount of light $L_0$ is taken as density data $D_s1$. That is, the maximum amount of light satisfying $D_s \geqq D_{smin}+V_0$ is the reference amount of light $L_0$. If $D_s<D_{smin}+V_0$, an output of the reflection type photosensor 24 is saturated. Even if the amount of light to be irradiated is increased after the condition is satisfied, the density data $D_s$ hardly changes. Consequently, the reference amount of light $L_0$ is an amount of light slightly lower than an amount of light in which the output of the sensor 24 is saturated. The above described constant $V_0$ is determined by experiments so that an amount of light in which the output of the sensor 24 sufficiently changes with respect to the change in density is set to the reference amount of light $L_0$.

The photosensitive drum 10 is then rotated, and light of the reference amount $L_0$ is irradiated from the light emitting element 24*a* onto the photosensitive drum 10 which is being rotated. At this time, the light emitting element 24*a*emits light a plurality of times while the photosensitive drum 10 is rotated once. The average of the plurality of density data $D_s$ acquired at this time is found as average density data $D_{sav}$. The plurality of density data $D_s$ respectively acquired by irradiating light of the amounts L in the plurality of steps onto the photosensitive drum 10 in the stationary state are corrected on the basis of the average density data $D_{sav}$, the density data $D_s1$ corresponding to the reference amount of light $L_0$ and the density data $D_{smax}$ corresponding to the maximum amount of light $L_{max}$. Specifically, density data $D_s'$ after the correction are given by the following equation (2):

$$D_s'=D_s\ (D_{smax}-D_{sav})/(D_{smax}-D_s1)+D_{smax}\ (D_{sav}-D_s1)/(D_{smax}-D_s1) \quad (2)$$

Consequently, suitable density data considering the variation in the circumferential direction of the photosensitive drum 10 are obtained.

Density data are thus acquired in each of portions distributed over the periphery of the photosensitive drum 10 with respect to only the reference amount of light $L_0$ out of the amounts of light L in the plurality of steps. Consequently, the time required to acquire density data can be shortened, as compared with that in a case where density data are acquired in each of the portions over the periphery of the photosensitive drum 10 with respect to the amounts of light L in all the steps. Moreover, the total amount of light irradiated onto the photosensitive drum 10 is small, thereby making it possible to reduce light-induced fatigue of the photosensitive drum 10.

After the density data has been acquired, a first amount of light for low density $LN_1$ and a first amount of light for high density $LX_1$ are found (step S2). Specifically, an amount of light corresponding to the minimum density data $D_s'$ which satisfies the following expression (3) out of the density data $D_s'$ after the correction (the maximum amount of light for which the following expression (3) is satisfied) is taken as the first amount of light for low density $LN_1$:

$$D_s \geqq D_{smin}+V_0' \quad (3)$$

where $V_0'$=0.4 (V), for example.

It is preferable that the density data $D_s'$ which does not satisfy the foregoing expression (3) is not used because such data are data in a region where the output of the sensor 24 is saturated. The above described constant $V_0'$ is determined by experiments so that an amount of light in which the output of the sensor 24 can sufficiently change with respect to the change in density becomes the first amount of light for low density $LN_1$.

On the other hand, the first amount of light for high density $LX_1$ is found by substituting the first amount of light for low density $LN_1$ found as described above into a predetermined conversion equation.

For example, when the amounts of light L are set in sixty-four steps from 0 to 63, the first amount of light for high density $LX_1$ may be found by substituting the first amount of light for low density $LN_1$ into the following conversion equations:

$$\text{If } LN_1=0 \text{ to } 15,\ LX_1=2LN_1+2 \quad (4)$$

$$\text{If } LN_1=16 \text{ to } 23,\ LX_1=0.108(LN_1)^2-0.28LN_1+11 \quad (5)$$

If $LN_1>23$, the amount of light for high density $LX_1$ must take a value of not less than 64, whereby the setting becomes impossible. In such a case, it is considered that any abnormality occurs in the density detecting device 23.

In producing the above described conversion equations, suitable values of the first amount of light for high density $LX_1$ are respectively found by experiments with respect to a plurality of values of the first amount of light for low density $LN_1$. The above described conversion equations are determined so that the results of the experiments can be approximated.

For example, a density intermediate between the density of a toner image on the photosensitive drum 10 which has not been developed and the density of a solid black toner image will be referred to as an intermediate density. It is preferable that the amount of light for low density LN is set so that the output of the reflection type photosensor 24 reaches the maximum (the top) at the intermediate density. On the other hand, it is preferable that the amount of light for high density LX is set so that the output of the reflection type photosensor 24 rises at the intermediate density and reaches the maximum (the top) at a solid black toner image.

At the time of image forming condition adjusting processing as described later, a second amount of light for low density $LN_2$ is found similarly to the first amount of light for low density $LN_1$, and a second amount of light for high density $LX_2$ is found similarly to the first amount of light for high density $LX_1$. The second amount of light for low density $LN_2$ or the second amount of light for high density $LX_2$ is used for detecting fog, and the second amount of light for high density $LX_2$ is used for detecting a solid black.

In adjusting the image forming conditions, either of the pseudo originals 22*a* or 22*b* is illuminated, and the toner image is formed on the surface of the photosensitive drum 10, as described above. Even if the density of the real original 1 and the density of the pseudo originals 22*a* or 22*b* are equal, however, the amount of reflected light introduced into the photosensitive drum 10 (the amount of exposure) differs due to a structural factor peculiar to each electrostatic copying machine such as the difference in the set position depending on a case where the pseudo original 22*a* or 22*b* is illuminated and a case where the real original 1 is illuminated and scanned. For example, when the pseudo originals 22*a* and 22*b* are closer to the light source 4, as compared with the real original 1, the amount of exposure in a case where the real original 1 is illuminated and scanned is made larger than that in a case where the pseudo originals 22*a* or 22*b* is illuminated. The reason for this is that the light source 4 is generally designed so that light is converged on the surface of the real original 1. Consequently, there is a difference between the density of a toner image formed by illuminating and scanning a pure white region of the real original 1 and the density of a toner image formed by illuminating the pseudo original 22*a* on which a pure white image is formed. Thus, even under the condition in which the pure white image of the real original 1 is reproduced without fog, the toner image corresponding to the pseudo original 22*a* may have a relatively high density. The density of the toner image corresponding to the pseudo original 22*a* therefore may not be detected precisely with the second amount of light for low density in some machines. Thus, the image density is not always properly adjusted.

In the initialization processing according to the present embodiment, the difference in the density between a toner image formed by illuminating the real original 1 on which a pure white image is formed and a toner image formed by illuminating the pure white pseudo original 22*a* is found, as shown in FIG. 3 (step S3). Either the second amount of light for low density $LN_2$ or the second amount of light for high density $LX_2$ is taken as the amount of light to be irradiated for fog detection is chosen depending on whether or not the found difference in the density is not less than a predetermined threshold value (step S4).

For example, if the above described difference in the density is not less than the above described threshold value, the density of the toner image formed by illuminating the pseudo original 22*a* becomes relatively high, and hence the second amount of light for high density $LX_2$ is taken as the amount of light to be irradiated for fog detection. On the other hand, if the difference in the density is less than the threshold value, the density of the toner image formed by illuminating the pseudo original 22*a* is not too high, whereby the second amount of light for low density $LN_2$ is employed for fog detection.

Correcting reference data $D_{ST}$ generating processing for generating correcting reference data $D_{ST}$ which is the first reference data is then performed (step S5). The correcting reference data $D_{ST}$ is data for correcting density data outputted from the reflection type photosensor 24 when the second amount of light for high density $LX_2$ is taken as an amount of light to be irradiated from the light emitting element 24*a* at the time of the image forming condition adjusting processing.

Once the correcting reference data $D_{ST}$ has been found, the initialization processing is terminated.

Figure 4:
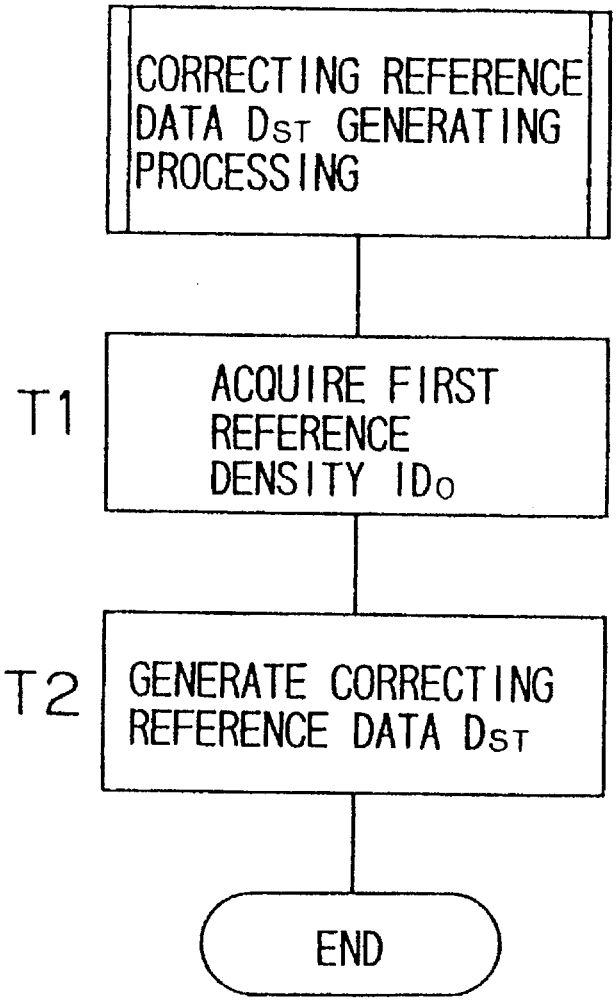
FIG. 4 is a flow chart for explaining the correcting reference data $D_{ST}$ generating processing in the electrostatic copying machine.
Figure 6:
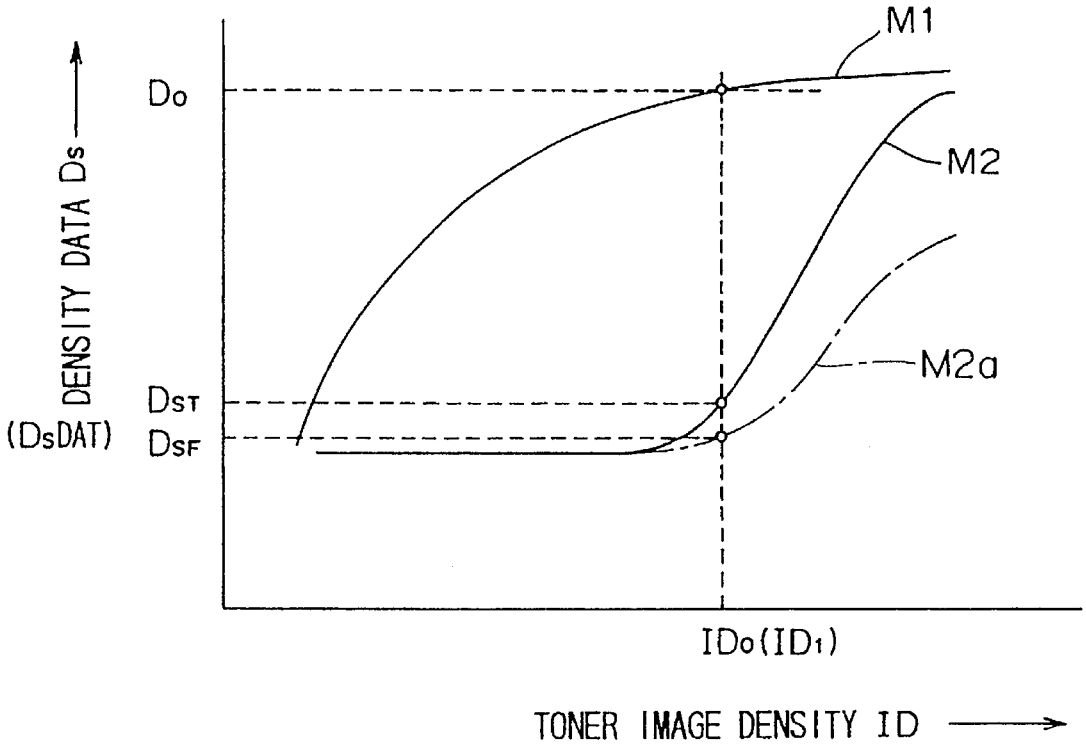
FIG. 6 is a diagram showing a low-density set data curve and a high-density set data curve which are outputs of a reflection type photosensor in which a first amount of light for low density and a first amount of light for high density are respectively set.
Figure 7:
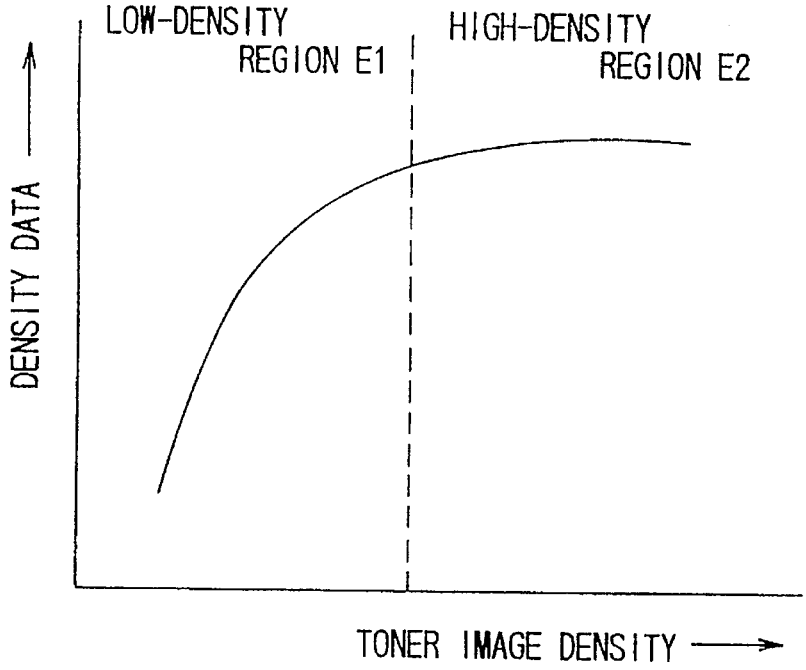
FIG. 7 is a diagram showing the relationship between a toner image density and density data outputted from the reflection type photosensor in which an amount of light for low density is set.
Figure 8:
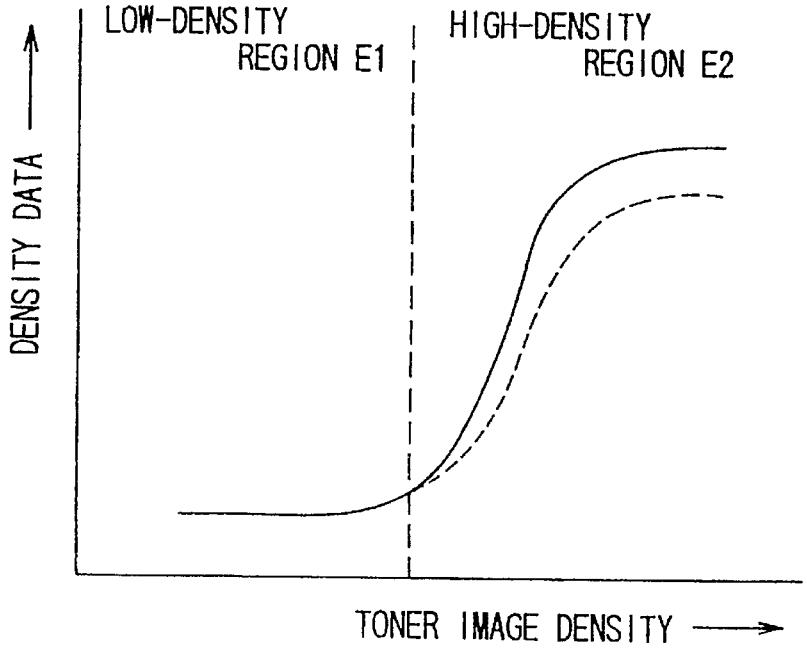
FIG. 8 is a diagram showing the relationship between a toner image density and density data outputted from the reflection type photosensor in which an amount of light for high density is set.

FIG. 4 is a flow chart for explaining the correcting reference data $D_{ST}$ generating processing. In the correcting reference data $D_{ST}$ generating processing, a reference density $ID_0$ is first found (step T1). More specifically, the first amount of light for low density $LN_1$ found in the step S2 of the initialization processing is set in the reflection type photosensor 24, and the pseudo original 22*a* is illuminated by the light source 4. At this time, the photosensitive drum 21 is rotated while the light source 4 is controlled to vary the amount of exposure, whereby a toner image forming operation is performed by the function of the developing device 14 and the like. As a result, a toner image having a plurality of regions which differ in density is formed on the surface of the photosensitive drum 10. The density in each of the regions of the toner image is detected by the reflection type photosensor 24, and density data outputted by the sensor 24 is acquired for each region. The actual density in each of the regions of the toner image corresponds to the amount of exposure corresponding to the region, thereby making it possible to obtain a low-density set data curve M1 shown in FIG. 6 representing the relationship between a toner image density and density data. In the low-density set data curve M1, a toner image density ID corresponding to predetermined first density data $D_0$ (for example, $D_0$=4.35±0.04 (V)) is taken as a first reference density $ID_0$. The above described low-density set data curve M1 is stored in the nonvolatile memory 31 and is made use of at the time of the image forming condition adjusting processing.

After the first reference density $ID_0$ has been found, the first amount of light for high density $LX_1$ found in the step S2 of the initialization processing is set in the reflection type photosensor 24 at that time. In the same manner as described above, a high-density set data curve M2 as shown in FIG. 6 is acquired. In the high-density set data curve M2, density data $D_s$ corresponding to the above described first reference density $ID_0$ is taken as the correcting reference data $D_{ST}$ (step T2). That is, the correcting reference data $D_{ST}$ is density data which is obtained for the first amount of light for high density $LX_1$ and which corresponds to the first reference density $ID_0$ at which the first density data $D_0$ can be obtained for the first amount of light for low density $LN_1$. The high-density set data curve M2 is also stored in the nonvolatile memory 31 and is made use of at the time of the image forming condition adjusting processing.

It is preferable that the first density data $D_0$ is set to be slightly lower than the saturation point of the output of the reflection type photosensor 24 in which the first amount of light for low density $LN_1$ is set. As a result, the first reference density $ID_0$ can be set to a density at which the output of the reflection type photosensor 24 is not saturated in either amount of light, the first amount of light for low density $LN_1$ or the first amount of light for high density $LX_1$.

Figure 5:
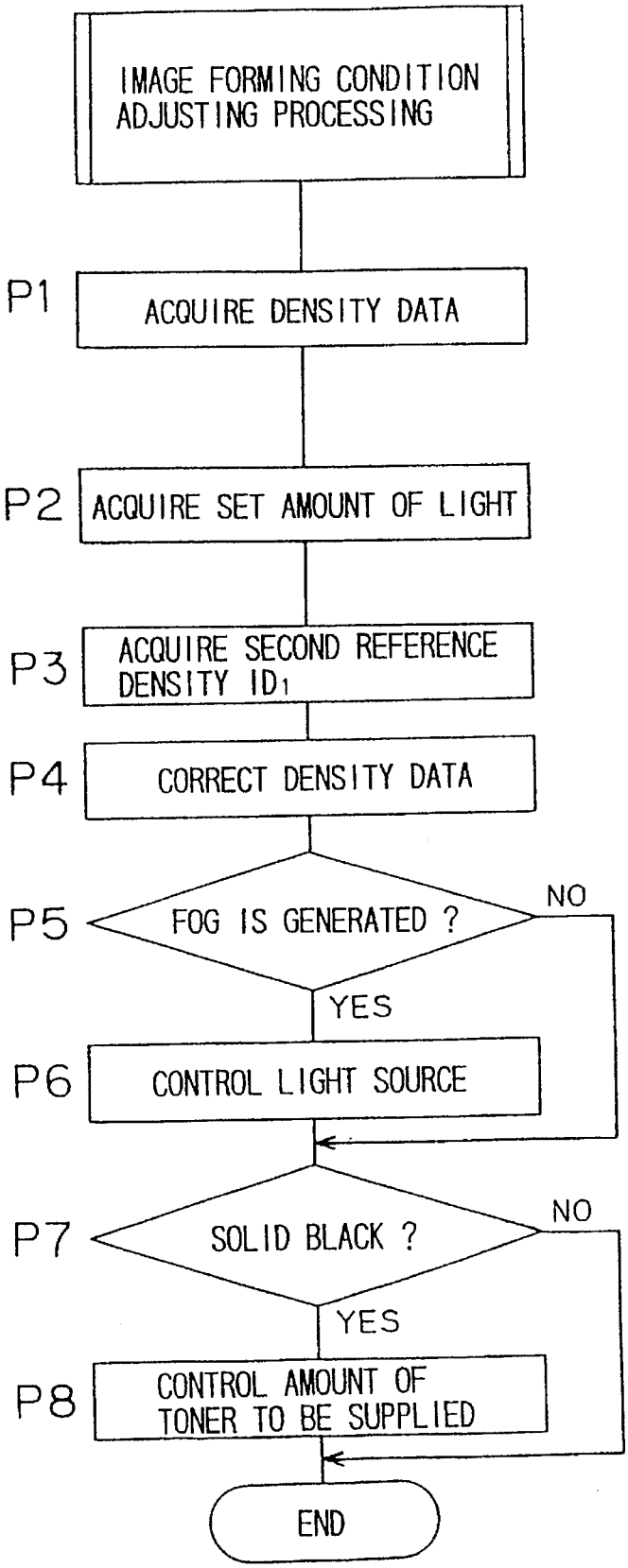
FIG. 5 is a flow chart for explaining image forming condition adjusting processing in the electrostatic copying machine.

FIG. 5 is a flow chart for explaining the image forming condition adjusting processing. The image forming condition adjusting processing is performed for each predetermined time period (for example, for every 60,000 copies), for example, at the time of maintenance. More specifically, the same processing as the density data acquiring processing and the set light amount acquiring processing explained in FIG. 3 is first performed. The second amount of light for low density $LN_2$ is found similarly to the first amount of light for low density $LN_1$, and the second amount of light for high density $LX_2$ is acquired similarly to the first amount of light for high density $LX_1$ (steps P1 and P2). A second reference density $ID_1$ is then found (step P3). The second reference density $ID_1$ is found in approximately the same manner as the first reference density $ID_0$. That is, density data slightly lower than the saturation point of the output of the reflection type photosensor 24 in which the second amount of light for low density $LN_2$ is set is taken as a second density data $D_1$. In the second amount of light for low density $LN_2$, a toner image density corresponding to the second density data $D_1$ is taken as the second reference density $ID_1$. The second reference density $ID_1$ is approximately the same as the first reference density $ID_0$. The second density data $D_1$ takes a value within the range of precision of $\pm\alpha$ (for example, $\alpha$=0.02 (V)) with respect to the first density data $D_0$, that is, $D_0 \pm \alpha$.

Once the second reference density $ID_1$ has been found, the density data outputted from the reflection type photosensor 24 in which the second amount of light for high density $LX_2$ is set at the time of the initialization is corrected (step P4). That is, a plurality of density data $D_s$DAT acquired with respect to toner images having densities in a plurality of steps in a state where the first amount of light for high density $LX_1$ is set at the time of the initialization processing are corrected. The density data $D_sDAT$ are the data forming the above described high-density set data curve M2 and are stored in the nonvolatile memory 31.

When the second amount of light for low density $LN_2$ is set, the input-output characteristics of the reflection type photosensor 24 are not so different from the input-output characteristics in a case where the first amount of light for low density $LN_1$ is set at the time of the initialization. When the second amount of light for low density $LN_2$ is set to detect a toner image density, therefore, it is safe to refer to the low-density set data curve M1 obtained at the time of the initialization. On the other hand, the input-output characteristics of the sensor 24 in a case where the second amount of light for high density $LX_2$ is set at the time of the image forming condition adjusting processing significantly deviate from the input-output characteristics of the sensor 24 in a case where the first amount of light for high density $LX_1$ is set at the time of the initialization processing. The reason for this is that the amounts of light for low density $LN_1$ and $LN_2$ are set on the basis of the actual results of the density detection, while the amounts of light for high density $LX_1$ and $LX_2$ are found by substituting the amounts of light for low density $LN_1$ and $LN_2$ in the conversion equations. That is, a suitable relationship between the amount of light for low density and the amount of light for high density differ between the time of the initialization and the time of the image forming condition adjusting processing. Toner and paper particles adhering on a light emitting surface and a light receiving surface of the reflection type photosensor 24 are the main cause.

When the second amount of light for high density $LX_2$ is set at the time of the image forming condition adjusting processing, therefore, the high-density set data curve M2 acquired at the time of the initialization processing cannot be referred to as it is. Therefore, the processing in the step P4 based on the correcting reference data $D_{ST}$ acquired at the time the initialization is performed.

More specifically, the pseudo original **22*a* is first illuminated in an amount of exposure corresponding to the second reference density $ID_1$. A toner image having the second reference density $ID_1$ is formed on the surface of the photosensitive drum 10 by the function of the developing device 14 and the like. The density of the toner image having the second reference density $ID_1$ is detected by the reflection type photosensor 24** in which the second amount of light for high density $LX_2$ is set, and outputted density data is taken as second reference data $D_{SF}$.

The input-output characteristics of the reflection type photosensor 24 corresponding to the second amount of light for high density $LX_2$ become a high-density set data curve M2*a* shown in FIG. 6, for example, due to the effect of toner and paper particles adhering on the light emitting surface and the light receiving surface, which differ from the input-output characteristics in a case where the first amount of light for high density $LX_1$ is set at the time of the initialization. In the high-density set data curve M2*a*, density data corresponding to the second reference density $ID_1$ is the second reference data $D_{SF}$.

When the second reference data $D_{SF}$ is found, a correction factor K is found by the following equation on the basis of the second reference data $D_{SF}$ and the correcting reference data $D_{ST}$ found at the time of the initialization processing:

$$K=D_{ST}/D_{SF} \tag{6}$$

The plurality of density data $D_sDAT$ acquired at the time of the initialization processing are used in a form corrected on the basis of the correction factor K. That is, at the time of the image forming condition adjusting processing, the plurality of density data acquired at the time of the initialization are treated as density data $D_sDAT'$ after the correction indicated by the following equation (7). The data $D_sDAT'$ after the correction and the data $D_sDAT$ before the correction are stored in the RAM 32 in the control circuit 26 with the correspondence established therebetween.

$$D_sDAT'=K\times D_sDAT \tag{7}$$

For example, the actual output data of the reflection type photosensor 24 corresponding to the reference density $ID_0$ is $D_{SF}$. Data after the correction of density data corresponding to the density data $D_{SF}$ and acquired at the time of the initialization processing is as follows when it is calculated in accordance with the foregoing equation (7):

$$D_sDAT'=K\times D_{SF}=(D_{ST}/D_{SF})\times D_{SF=DST} \tag{8}$$

The data $D_sDAT'$ ($=D_{ST}$) after the correction is regarded as data acquired at the time of the initialization processing, and is applied to the high-density set data curve M2 acquired at the time of the initialization processing, whereby the toner image density $ID_0$ is obtained.

By the above described correction, the toner image density can be thus accurately detected making use of the density data $D_sDAT$ obtained at the time of the initialization even when the input-output characteristics of the reflection type photosensor 24 differ from the high-density set data curve M2 stored in the nonvolatile memory 31.

After the correction of the density data $D_sDAT$ is terminated (step P4), it is then determined whether or not fog is generated (step P5). Specifically, the pseudo original **22*a* on which a pure white image is formed is illuminated, and a toner image forming operation is performed. The amount of light to be irradiated onto the photosensitive drum 10 from the reflection type photosensor 24 is the set amount of light selected as the amount of light for detecting fog in the initialization processing out of the second amount of light for low density $LN_2$ and the second amount of light for high density $LX_2$. It is determined whether or not fog is generated on the basis of the density data outputted from the reflection type photosensor 24**.

As a result, when it is determined that fog is generated, the amount of light to be emitted from the light source 4 is increased (step P6).

A solid black is then detected (step P7). Specifically, the pseudo original **22*b* on which a solid black image is formed is illuminated, whereby a toner image corresponding to the pseudo original 22*b* is formed on the surface of the photosensitive drum 10. The density of the formed toner image is detected by the reflection type photosensor 24. At this time, the amount of light to be irradiated from the reflection type photosensor 24 is set to the second amount of light for high density $LX_2$. It is determined whether or not the toner image is solid black on the basis of the density data outputted from the reflection type photosensor 24**.

As a result, if it is determined that the toner image is not solid black, the toner hopper 13 is controlled. Specifically, the amount of toner to be supplied to the developing device 14 from the toner hopper 13 is increased (step P8).

Consequently, the adjustment of the image forming conditions is achieved, thereby making it possible to stably acquire an image high in quality.

When the second amount of light for high density $LX_2$ is set, the density data which is closest to the data outputted from the reflection type photosensor 24 out of the density data $D_s$DAT acquired at the time of the initialization is determined. Density data $D_s$DAT' after the correction corresponding to the found density data $D_s$DAT is then read out from the RAM 32 in the control circuit 26. Further, in the above described high-density set data curve M2, a toner image density corresponding to the read data $D_s$DAT' after the correction is found out. The toner image density is regarded as the density of a toner image which is an object to be detected.

As a result, when the first amount of light for high density $LX_1$ is set in the reflection type photosensor 24, the data $D_s$ outputted by the reflection type photosensor 24 is corrected in accordance with the following equation (9). Data $D_s''$ after the correction is applied to the input-output characteristics at the time of the initialization, thereby detecting a toner image density.

$$D_s''=K\times D_s \tag{9}$$

As described in the foregoing, in the electrostatic copying machine including the density detecting device 23 according to the present embodiment, when the second amount of light for high density $LX_2$ is set in the reflection type photosensor 24 to detect a toner image density at the time of the image forming condition adjusting processing, the density data from the reflection type photosensor 24 is corrected on the basis of the correcting reference data $D_{ST}$ and the second reference data $D_{SF}$ which are respectively acquired at the time of the initialization processing and the time of the image forming condition adjusting processing with respect to the toner image densities $ID_0$ and $ID_1$ which are approximately equal. Even if the input-output characteristics of the reflection type photosensor 24 differ from those at the time of the initialization by the adhesion of floating toner and the like on the light emitting surface or the light receiving surface of the reflection type photosensor 24, therefore, the toner image density can be satisfactorily detected by excluding the effect. Even when the second amount of light for high density $LX_2$ is set in the reflection type photosensor 24, therefore, it is possible to always accurately detect the toner image density. Consequently, the image forming conditions can be accurately adjusted, thereby making it possible to stably obtain an image high in quality.

Although the embodiment of the present invention has been described, the present invention is not limited to the above described embodiment. For example, although in the above described embodiment, an electrostatic copying machine is taken as an example, the present invention is also applicable to an arbitrary image forming apparatus in which an image is formed by the electrophotographic process, for example, a laser printer or a facsimile.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. A density detecting device for detecting a density of a toner image formed by an image forming apparatus including a photoreceptor on which an electrostatic latent image is formed and a developing device for developing the electrostatic latent image formed on the photoreceptor into a toner image, the density detecting device comprising:

a density sensor for irradiating light onto the photoreceptor to output density data corresponding to an amount of light reflected from the photoreceptor and capable of varying an amount of light to be irradiated onto the photoreceptor;

first low-density curve acquiring means, at a time of initialization, for setting a first amount of light for low density which is for detecting a toner image density in a low-density region as the amount of light to be irradiated onto the photoreceptor, and further for causing the density sensor to detect a density of a toner image having a known density, thereby to acquire a first low-density light amount characteristic curve of the density sensor;

high-density curve acquiring means, at the time of the initialization, for setting a first amount of light for high density which is for detecting a toner image density in a high-density region as the amount of light to be irradiated onto the photoreceptor, and further for causing the density sensor to detect a density of a toner image having a known density, thereby to acquire a high-density light amount characteristic curve of the density sensor;

first reference density acquiring means for acquiring a first reference density which is a toner image density corresponding to the first density data in the first low-density light amount characteristic curve;

first correcting reference data acquiring means for acquiring first correcting reference data which are density data corresponding to the first reference density in the high-density light amount characteristic curve;

low-density light amount acquiring means for finding a second amount of light for low density which is for detecting a toner image density in the low-density region at a time of density detection;

high-density light amount acquiring means for finding a second amount of light for high density which is for detecting a toner image density in the high-density region at the time of the density detection;

second low-density curve acquiring means for setting the second amount of light for low density as the amount of light to be irradiated onto the photoreceptor, and further for causing the density sensor to detect a density of a toner image having a known density, thereby to acquire a second low-density light amount characteristic curve of the density sensor;

second reference density acquiring means for acquiring a second reference density which is a toner image density corresponding to second density data in the second low-density light amount characteristic curve, the second density data being approximately equal to the first density data;

second correcting reference data acquiring means for setting the second amount of light for high density as the amount of light to be irradiated onto the photoreceptor, and further for causing the density sensor to detect a density of a toner image having the second reference density, thereby to acquire density data outputted by the density sensor as second correcting reference data;

density data correcting means for correcting the density data outputted by the density sensor on the basis of the first correcting reference data and the second correcting reference data when the second amount of light for high density is set to detect a toner image density by the density sensor, to output corrected density data; and density acquiring means for applying the corrected density data to the high-density light amount characteristic curve, thereby to acquire the toner image density.

2. The density detecting device according to claim 1, wherein the density data correcting means corrects the density data outputted by the density sensor on the basis of a ratio of the first correcting reference data to the second correcting reference data.

3. The density detecting device according to claim 1, wherein the density data correcting means corrects density data $D_S$ outputted by the density sensor in accordance with the following equation on the basis of the first correcting reference data $D_{ST}$ and the second correcting reference data $D_{SF}$, to obtain density data $D_S''$ after correction:

$$D_S''=K\times D_S \text{ where } K=D_{ST}/D_{SF}.$$

4. The density detecting device according to claim 1, wherein the density data correcting means corrects the high-density light amount characteristic curve on the basis of the first and second correcting reference data, and the density acquiring means applies the density data outputted by the density sensor to the high-density light amount characteristic curve after correction, thereby to acquire the toner image density.

5. The density detecting device according to claim 1, further comprising first storing means for storing the high-density light amount characteristic curve represented by a plurality of density data $D_S$DAT and a plurality of density values corresponding to the plurality of density data $D_S$DAT, wherein the density data correcting means respectively corrects the plurality of density data $D_S$DAT in accordance with the following equation on the basis of the first and second correcting reference data $D_{ST}$ and $D_{SF}$, to output density data $D_S$DAT' after correction, and the density acquiring means includes second storing means for storing the density data $D_S$DAT' after the correction and the density data $D_S$DAT before the correction with a correspondence established therebetween, means for finding the density data which is closest to the density data outputted by the density sensor out of the density data $D_S$DAT before the correction in the second storing means, means for reading out from the second storing means the density data $D_S$DAT' after the correction which corresponds to the found density data $D_S$DAT before the correction, and means for reading out from the first storing means the density value corresponding to the read density data $D_S$DAT' after the correction:

$$D_SDAT'=K\times D_SDAT \text{ where } K=D_{ST}/D_{SF}.$$

6. The density detecting device according to claim 1, wherein the density sensor is capable of irradiating light of amounts in a plurality of steps, the first amount of light for low density is an amount of light determined by performing the steps of: irradiating light of amounts in a plurality of steps by the density sensor onto the photoreceptor on which no toner adheres, finding out a maximum step of steps in which data outputted by the density sensor takes a value of not less than a predetermined value, and determining the amount of light in the maximum step as the first amount of light for low density, and the first amount of light for high density is an amount of light found by substituting the first amount of light for low density in a predetermined conversion equation.

7. The density detecting device according to claim 6, wherein the low density light amount acquiring means acquires the second amount of light for low density by performing the steps of: irradiating light of amounts in a plurality of steps by the density sensor onto the photoreceptor on which no toner adheres, finding out a maximum step of steps in which data outputted by the density sensor takes a value of not less than the predetermined value, and determining the amount of light in the maximum step as the second amount of light for low density, and the high-density light amount acquiring means acquires as a second amount of light for high density an amount of light found by substituting the second amount of light for low density in the predetermined conversion equation.

8. A method of detecting a density of a toner image using a density sensor for irradiating light of an amount which can be variably set onto a photoreceptor and outputting density data corresponding to an amount of light reflected from the photoreceptor, the method being applied to an image forming apparatus including the photoreceptor on which an electrostatic latent image is formed and a developing device for developing the electrostatic latent image formed on the photoreceptor into a toner image, the method comprising the steps of:

at a time of initialization, setting a first amount of light for low density which is for detecting a toner image density in a low-density region as an amount of light to be irradiated onto the photoreceptor from the density sensor;

detecting a density of a toner image having a known density by the density sensor in which the amount of light for low density is set, thereby to acquire a first low-density light amount characteristic curve of the density sensor;

setting a first amount of light for high density which is for detecting a toner image density in a high-density region as the amount of light to be irradiated onto the photoreceptor;

detecting a density of a toner image having a known density by the density sensor in which the first amount of light for high density is set, thereby to acquire a high-density light amount characteristic curve of the density sensor;

acquiring a toner image density corresponding to first density data in the first low-density light amount characteristic curve as a first reference density; and acquiring density data corresponding to the first reference density in the high-density light amount characteristic curve as first correcting reference data;

at a time of density detection, finding a second amount of light for low density which is for detecting a toner image density in the low-density region;

finding a second amount of light for high density which is for detecting a toner image density in the high-density region;

setting the second amount of light for low density as the amount of light to be irradiated onto the photoreceptor;

detecting a density of a toner image having a known density by the density sensor in which the second amount of light for low density is set, thereby to acquire a second low-density light amount characteristic curve of the density sensor;

acquiring a toner image density corresponding to second density data in the second low-density light amount characteristic curve as a second reference density, the second density data being approximately equal to the first density data;

setting the second amount of light for high density as the amount of light to be irradiated onto the photoreceptor;

detecting a density of a toner image having the second reference density by the density sensor in which the second amount of light for high density is set, thereby to acquire the density data outputted by the density sensor as second correcting reference data;

correcting the density data outputted by the density sensor on the basis of the first correcting reference data and the second correcting reference data when the second amount of light for high density is set to detect a toner image density by the density sensor; and applying the corrected density data to the high-density light amount characteristic curve, thereby to acquire the toner image density.

9. The method according to claim 8, wherein the step of correcting the density data includes the step of correcting the density data outputted by the density sensor on the basis of a ratio of the first correcting reference data to the second correcting reference data.

10. The method according to claim 8, wherein the step of correcting the density data includes the step of correcting density data $D_s$ outputted by the density sensor in accordance with the following equation on the basis of the first correcting reference data $D_{ST}$ and the second correcting reference data $D_{SF}$, to obtain corrected density data $D_S''$:

$$D_S''=K\times D_S \text{ where } K=D_{ST}/D_{SF}.$$

11. The method according to claim 8, wherein the step of correcting the density data includes the step of correcting the high-density light amount characteristic curve on the basis of the first and second correcting reference data, the step of acquiring the density includes the step of applying the density data outputted by the density sensor to the high-density light amount characteristic curve after correction, thereby to acquire the toner image density.

12. The method according to claim 8, further comprising the step of storing in first storing means the high-density light amount characteristic curve represented by a plurality of density data $D_S$DAT and a plurality of density values corresponding to the plurality of density data $D_S$DAT, wherein the step of correcting the density data includes the step of respectively correcting the plurality of density data $D_S$DAT in accordance with the following equation on the basis of the first and second correcting reference data $D_{ST}$ and $D_{SF}$, to acquire density data $D_S$DAT' after the correction, and the step of acquiring the density includes the steps of storing in second storing means the density data $D_S$DAT' after the correction and the density data $D_S$DAT before the correction with a correspondence established therebetween, finding the density data which is closest to the density data outputted by the density sensor out of the density data $D_S$DAT before the correction in the second storing means, reading out from the second storing means the density data $D_S$DAT' after the correction corresponding to the found density data $D_S$DAT before the correction, and reading out from the first storing means the density value corresponding to the read density data $D_S$DAT' after the correction:

$$D_S DAT'=K\times D_S DAT \text{ where } K=D_{ST}/D_{SF}.$$

13. The method according to claim 8, wherein the density sensor is capable of irradiating light in amounts in a plurality of steps, the first amount of light for low density is an amount of light determined by performing the steps of: irradiating light of amounts in a plurality of steps by the density sensor onto the photoreceptor on which no toner adheres, finding out a maximum step of steps in which data outputted by the density sensor takes a value of not less than a predetermined value, and determining the amount of light in the maximum step as the first amount of light for low density, and the first amount of light for high density is an amount of light found by substituting the first amount of light for low density in a predetermined conversion equation.

14. The method according to claim 13, wherein the step of acquiring the second amount of light for low density includes the steps of: irradiating light of amounts in a plurality of steps by the density sensor onto the photoreceptor on which no toner adheres, finding out a maximum step of steps in which data outputted by the density sensor takes a value of not less than the predetermined value, and determining the amount of light in the maximum step as the second amount of light for low density, and the step of acquiring the second amount of light for high density includes the step of acquiring as a second amount of light for high density an amount of light found by substituting the second amount of light for low density in the predetermined conversion equation.

15. A density detecting device for detecting a density of a toner image formed by an image forming apparatus including a photoreceptor on which an electrostatic latent image is formed and a developing device for developing the electrostatic latent image formed on the photoreceptor into a toner image, the density detecting device comprising;

a density sensor for irradiating light onto a photoreceptor to output density data corresponding to an amount of light reflected from the photoreceptor and capable of varying an amount of light to be irradiated onto the photoreceptor;

means for finding a first amount of light to be irradiated onto the photoreceptor to detect a toner image density from the density sensor at a time of initialization;

characteristic curve acquiring means for setting the first amount of light as the amount of light to be irradiated onto the photoreceptor, and further for causing the density sensor to detect a density of a toner image having a known density, at the time of initialization, thereby to acquire an input-output characteristic curve of the density sensor;

means for finding a second amount of light to be irradiated onto the photoreceptor from the density sensor in order to detect a toner image density at a time of density detection; and density operating means for referring to the density data outputted by the density sensor and the input-output characteristic curve, at the time of density detection, to find the toner image density.

16. A method of detecting a density of a toner image using a density sensor for irradiating light onto a photoreceptor and outputting density data corresponding to an amount of light reflected from the photoreceptor and capable of varying an amount of light to be irradiated onto the photoreceptor, the method being applied to an image forming apparatus including a photoreceptor on which an electrostatic latent image is formed and a developing device for developing the electrostatic latent image formed on the photoreceptor into a toner image, the method comprising the steps of:

at a time of initialization, finding a first amount of light to be irradiated onto the photoreceptor to detect a toner image density from the density sensor; and setting the first amount of light as the amount of light to be irradiated onto the photoreceptor; and causing the density sensor to detect a density of a toner image having a known density by the density sensor in which the first amount of light is set, thereby to acquire an input-output characteristic curve of the density sensor;

at a time of density detection, finding a second amount of light to be irradiated onto the photoreceptor to detect a toner image density from the density sensor, and referring to the density data outputted by the density sensor and the input-output characteristic curve, to find the toner image density.

* * * * *